United States Patent [19]

Eylers

[11] Patent Number: 4,608,733

[45] Date of Patent: Sep. 2, 1986

[54] SYSTEM FOR FASTENING POCKET CLIPS TO METAL CAPS OR BARRELS OF WRITING INSTRUMENTS

[75] Inventor: Dieter Eylers, Idar-Oberstein, Fed. Rep. of Germany

[73] Assignee: Gottlieb Roll GmbH & Co., Idar-Oberstein, Fed. Rep. of Germany

[21] Appl. No.: 619,900

[22] Filed: Jun. 12, 1984

[30] Foreign Application Priority Data

Jul. 23, 1983 [DE] Fed. Rep. of Germany ..... 3326678

[51] Int. Cl.[4] ..... B43K 25/00

[52] U.S. Cl. ..... 24/11 F; 24/3 L

[58] Field of Search ..... 24/3 H, 3 L, 11 R, 703, 24/11 HC, 11 CT, 11 F, 11 PP, 11 S, 11 FE, 11 P, 11 CC, 599; 401/104, 131, 243

[56] References Cited

U.S. PATENT DOCUMENTS

| | | | |
|---|---|---|---|
| 1,679,232 | 7/1928 | Shure | 24/11 F |
| 2,115,363 | 4/1938 | Gency | 24/703 X |
| 2,276,513 | 3/1942 | Petau | 24/11 F |
| 2,276,891 | 3/1942 | Stenersen | 24/11 F |
| 2,962,692 | 11/1960 | White | 24/703 X |
| 3,016,593 | 1/1962 | Rowles | 24/599 |
| 3,033,167 | 5/1962 | Spillman | 401/104 |
| 3,842,466 | 10/1974 | Katz et al. | 24/11 F |

FOREIGN PATENT DOCUMENTS

| | | | |
|---|---|---|---|
| 1148155 | 5/1963 | Fed. Rep. of Germany | 401/104 |
| 67718 | 3/1955 | France | 401/104 |
| 1150717 | 3/1956 | France | 401/104 |
| 577690 | 6/1958 | Italy | 401/104 |

*Primary Examiner*—William E. Lyddane
*Assistant Examiner*—James R. Brittain

[57] ABSTRACT

A pocket clip made by stamping in one piece from spring metal, which is securely attached to a metal writing instrument, such as a fountain pen or ball point pen simply by pushing it, manually or by machine, into an opening provided in the cap or barrel of the writing instrument, whereupon the clip automatically locks itself onto projections extending from the sides of the opening.

7 Claims, 9 Drawing Figures

FIG. 1a
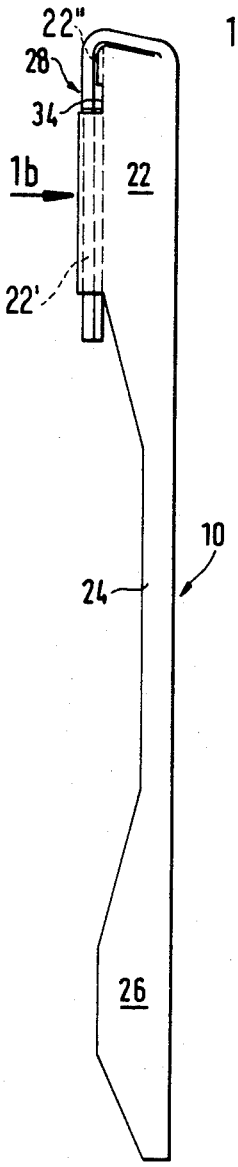
FIG. 1b
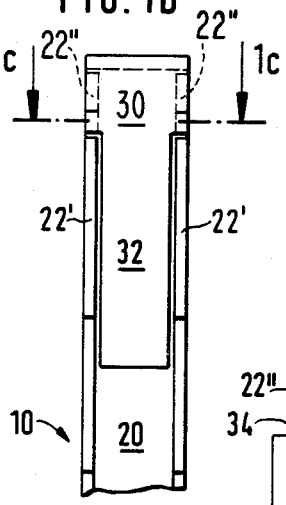
FIG. 1c
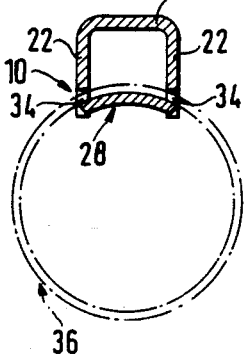
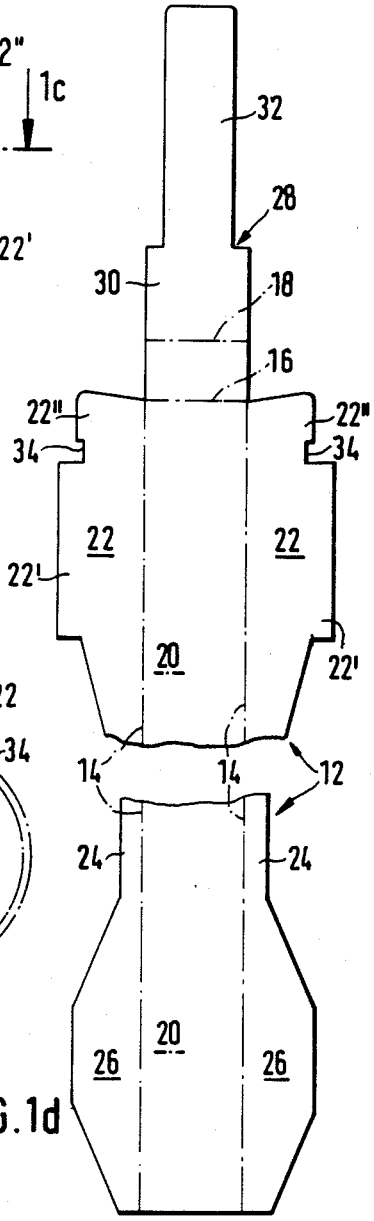
FIG. 1d

SYSTEM FOR FASTENING POCKET CLIPS TO METAL CAPS OR BARRELS OF WRITING INSTRUMENTS

BACKGROUND OF THE INVENTION

The invention relates to a system for fastening pocket clips to metal caps or barrels of writing instruments, such as ball-point pens or fountain pens, or the like, having a pocket clip with a clasp stamped out of spring metal strip material fastened at its upper end to the cap or barrel and urged resiliently at its lower end against the cap or barrel, as the case may be.

Pocket clips were originally fastened to the caps or barrels of ball-point pens or fountain pens by means of a ring formed on one end of the clasp proper and bent at right angles thereto, which was held between two parts of the cap or barrel, which were screwed, cemented or otherwise joined to one another. The installation of pocket clips on caps or barrels injection molded from plastic could, on the other hand, be made substantially more simply by providing on the end of the clasp a fastening tab having lateral, bent-back, barbed projections which are inserted into a complementary mounting opening formed in the cap or barrel and are prevented from withdrawal by the barbs penetrating into the plastic material. In the case of thin-walled metal caps or barrels however, it is not possible to mount the pocket clips in this manner.

It is therefore the object of the invention to create an arrangement for fastening pocket clips to thin-walled caps or barrels of writing instruments consisting of metal material, which will permit the pocket clip to be attached quickly and easily to its associated cap or barrel so as not to break out of it under the stresses anticipated.

THE INVENTION

Setting out from a fastening system of the kind mentioned above, this object is achieved in accordance with the invention by the fact that the clasp proper has at its upper end two tabs bent back toward the cap or barrel from its longitudinal margins, that the mounting portion of the pocket clip is elongated beyond the upper end of the tabs to form a tongue which is bent back in the direction of the cap or barrel at the upper ends of the tabs and then is bent downwardly to a position between the tabs in which it is substantially parallel to the clasp, the length of the tongue being made such that the rest of its free portion extends past the tabs toward the bottom of the pocket clip, and that a substantially rectangular opening is provided in the cap or barrel to accommodate the tabs, while from each of the opposite longitudinal edges of the rectangular opening a short projection points towards the opposite longitudinal edge, each of these short projections being able to snap under the tongue and into an associated notch formed in the back edges of the bent-back tabs of the clasp.

The installation of the pocket clip in the substantially rectangular opening provided therefor in the cap or barrel of the pen is performed first by inserting the free end of the tongue through the opening and downwardly into the interior of the cap or barrel, and then, by applying pressure to the upper end of the clasp, sliding the tongue over the projections extending from the margins of the opening until these projections snap into the notches provided in the clasp tabs. It can easily be understood that this operation can be performed not just by hand but that it is also relatively simple to perform by automatic machinery.

In a preferred embodiment of the invention, the tabs bent back from the clasp are extended along the entire length of the clasp, but with a smaller width, so as to form a channel to strengthen the clasp against deflection. The clasp itself is thus made relatively stiff, while its resilient pressure against the cap or barrel of the writing instrument is produced substantially by the doubled-back tongue of the clip.

In the area of the bottom end of the clasp, the sides of the channel are widened again such that they engage with bias the outside of the cap or barrel of the writing instrument, thus constituting the usual gripping point of pocket clips of this kind.

It is desirable for the portion of the tongue of the pocket clip that is parallel with the clasp to be pressed into a curved shape across its width having a radius corresponding approximately to the inside radius of the cap or barrel. The end of the tongue extending beyond the tabs will thus conform to the interior shape of the cap or barrel.

In a desirable further development of the invention, the tongue section directly adjoining the web portion of the clasp between the tabs is of approximately the same width as the web portion, and this section is bent back against the upper edge and part of the rear edge of the bent tabs, while the remainder of the tongue is narrower accordingly all the way to its free end, and is fitted between the confronting inside surfaces of the tabs.

At the same time, the tabs will have a greater width in the portion accommodating the narrower part of the tongue between them than they do in the portion which is overlapped by the wider part of the tongue. In that case the notches which accommodate the projections extending from the lateral edges of the opening in the cap or barrel are provided in those edges of the tabs which are overlapped by the wider portion of the tongue.

The invention will be further explained in the description that follows of an embodiment which is represented in the appended drawing.

DESCRIPTION OF THE DRAWING

FIG. 1*a* is a side view of a pocket clip for installation in accordance with the invention, FIG. 1*b* is a view of the upper end of the pocket clip, seen in the direction of the arrow 1*b* of FIG. 1*a*, FIG. 1*c* is a cross section taken through the pocket clip as seen in the direction of the arrows 1*c*—1*c*, FIG. 1*d* is a plan view of the cut blank for making the pocket clip.

DESCRIPTION OF A PREFERRED EMBODIMENT

Figure 2A:
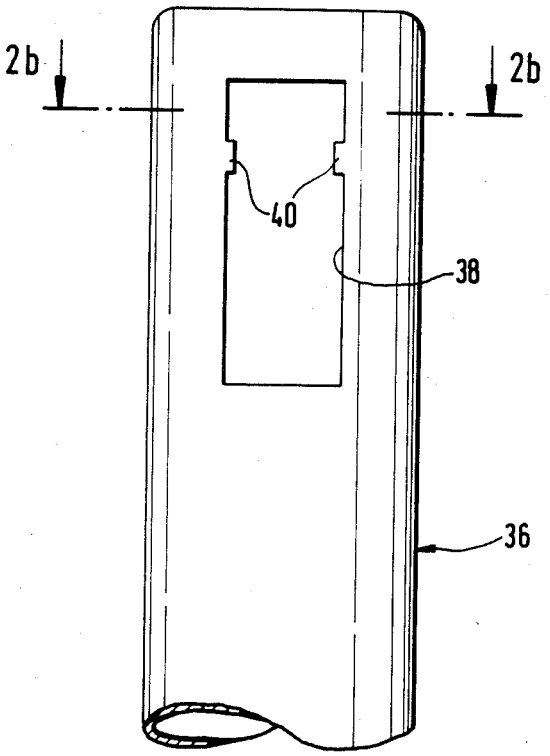
FIG. 2*a* is a side view of the upper part of a thin-walled metal fountain pen cap to which the pocket clip shown in FIGS. 1*a* to 1*c* is to be fastened.

The pocket clip shown in FIGS. 1*a* to 1*c*, and designated as a whole by the number 10, is first stamped out of spring-elastic, metal strip material in the form of the elongated blank 12 represented in FIG. 1*d*, and then formed into the ready-to-install, pocket clip 10 by bending it over along the broken lines 14, 16 and 18. By bending at right angles along the broken lines 14, the blank is formed into a channel having a web 20 and upper flange portions 22 and lower flange portions 26 joined together by narrower flange portions 24. The portion of the blank 12 consisting of the web 20 with the flange portions 22, 24 and 26 then constitutes the external part, or clasp, of the pocket clip 10.

The web 20 merges at the upper end of the clasp with a tongue 28 projecting longitudinally beyond the upper flange portions or tabs 22, which in its first portion 30 adjoining the web is of approximately the same width as the web. In its remaining portion 32 the tongue 28 is reduced in width. After the flange portions 22, 24 and 26 have been bent back from the web 20, the tongue is first bent back along line 16 and then downwardly along line 18 against the edges of the flange portions 22, overlapping these edges in its first, wider section 30. Its narrower portion 32, however, lies between the inside faces of the flange portions which accordingly are slightly wider in the section 22' associated with the narrower tongue section 32 than they are in their upper section 22''. In the upper section 22'' of each flange, or tab, 22, there is provided a notch 34 which forms an opening with the tongue 28 when the latter is bent on the lines 16 and 18.

Figure 2B:
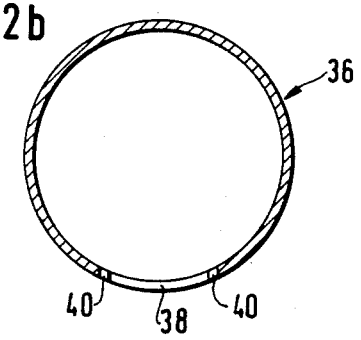
FIG. 2*b* is a section through the fountain pen cap, seen in the direction of the arrows 2*b*13 2*b*.

The portion of tongue 28 situated above the bend line 18 in FIG. 1*d* is furthermore best curved across its width in the manner seen in FIG. 1*c*, the radius of curvature corresponding approximately to the radius of curvature of the inside of the fountain pen cap which will be further described in conjunction with FIGS. 2*a* and 2*b*.

In the case represented in the drawing, the fountain pen cap 36 is a cylindrical capsule of thin metal closed at its upper end, while its open bottom end can be fitted over either end of a fountain pen.

A substantially rectangular, window-like opening 38 is cut or stamped in the cap 36 adjacent its closed upper end, and is just sufficiently large to accommodate the tab-like portions 22' of the flange portions 22 as well as the bent, wider portion 30 of the tongue 28. A short projection 40 extends from each of the longitudinal edges of the opening 38 towards the opposite edge and, when the pocket clip 10 is properly fastened to the cap 36, these projections are engaged in the openings 34 in the manner shown in FIGS. 3*a*, 3*b* and 3*c*, and thus fix the pocket clip 10 in the opening 38.

Figure 3A:
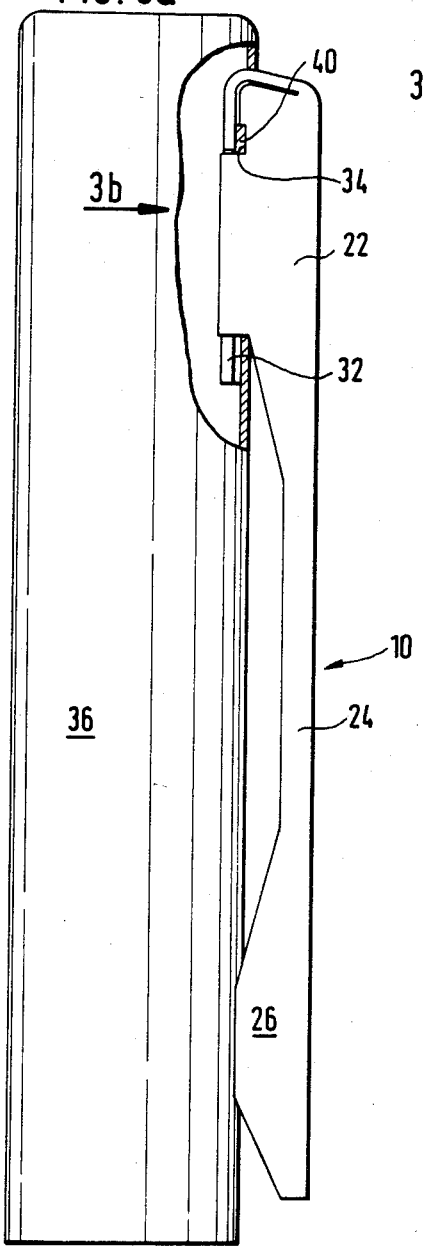
FIG. 3*a* is a side view of a fountain pen cap with the pocket clip installed, the cap being cut away in the area in which the clip is fastened.
Figure 3B:
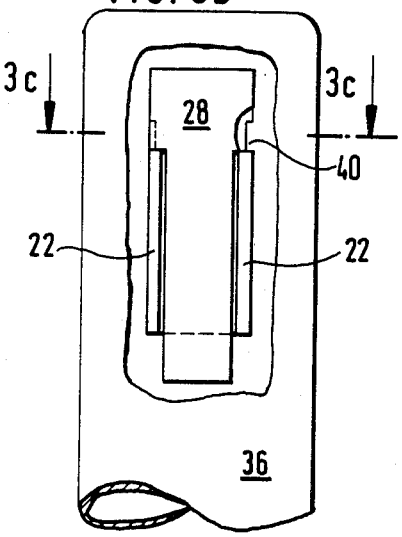
FIG. 3*b* is a view taken in the direction of arrow 3*b* of FIG. 3*a*, i.e., a view of the clip as seen from the inside of the fountain pen cap.
Figure 3C:
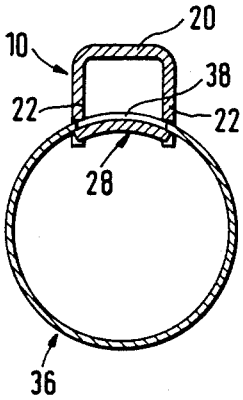
FIG. 3*c* is a cross section seen in the direction of arrows 3*c*—3*c* of FIG. 3*b*.

The fountain pen cap 36 with the pocket clip 10 fastened to it is shown in FIGS. 3*a*, 3*b* and 3*c*. As best seen in FIGS. 3*a* and 3*b*, the free end of tongue 28 extending beyond the tab-like flanges 22 toward the bottom end of the clasp reaches beyond the bottom transverse edge of the opening 38 and, in cooperation with the projections 40 engaged in the notches 34, holds the pocket clip securely on the cap 36. On account of the above-mentioned curvature of the end section 32 of tongue 28, the part of the tongue that is situated inside of the cap 36 will be fitted to the interior shape of the cap, as can be seen in FIG. 3*c*.

The installation of the pocket clip 10 on the cap 36 is performed by first pushing the free end section 32 of tongue 28 over the bottom edge of the opening 38 and then pressing the upper end of the pocket clip radially into the opening 38, such that the projections 40 snap over the lateral edges of the tongue 28 into the notches 34. In this position, the tab-like flange sections 26 bent up from the web 20 apply themselves with bias to the outer surface of the cap 36 and thus form the point at which the material of a user's pocket is gripped to secure the cap against loss and thus also prevent the loss of the fountain pen held therein.

I claim:

1. A writing instrument pocket clip assembly, comprising: a capsular, metal part having a substantially rectangular opening confined in part by a lower edge and by two opposite lateral edges, said lateral edges respectively having relatively short projections extending towards each other; and a pocket clip of spring-elastic metal, said clip having a web extending substantially parallel to said capsular part, said web having an upper portion, two substantially planar first tabs respectively extending from opposite sides of said upper portion substantially at right angles to said web and towards said capsular part, said web having a tongue extending from said upper portion of said web, said tongue having a first portion connected to and extending transverse to said upper portion of said web towards said capsular part, said tongue also having a second portion connected to and extending substantially at right angles to said first portion, substantially parallel to said web, and between said first tabs; said rectangular opening of said capsular part snugly accommodating said first tabs, said projections matingly engaging associated notches in said first tabs and being located between said second portion of said tongue and said first tabs, said tongue having a free end extending below said first tabs and below said lower edge of said opening and resiliently resting on the inside of said capsular part, whereby said clip is fastened on said capsular part.

2. A pocket clip assembly according to claim 1, wherein said web has a lower portion with second tabs extending substantially at right angles from said lower portion to stiffen the web against resilient yielding, the height of said second tabs being lower than that of said first tabs.

3. A pocket clip assembly according to claim 2, wherein said lower portion of said web has a free end, said second tabs increasing in height at said free end of said lower portion, and resiliently engaging said capsular part.

4. A pocket clip assembly according to claim 1, wherein said second portion of said tongue is curved with a radius of curvature corresponding approximately to the inside of the capsular part.

5. A pocket clip assembly according to claim 4, wherein said first and second portions of said tongue have about the same width as said upper portion of said web, said free end of said tongue has a width smaller than said upper portion of said web and extends between said first tabs of said upper portion.

6. A pocket clip assembly according to claim 5, wherein said first tabs have first portions of a first height and receiving therebetween said second portions of said tongue, said first tabs also having second portions adjacent said first portions and of a height lower than said first height and arranged adjacent said first portion of said tongue.

7. A pocket clip assembly according to claim 6, wherein said notches are located between said first and second portions of said first tabs.

* * * * *